US006655181B2

(12) United States Patent
Morales

(10) Patent No.: US 6,655,181 B2
(45) Date of Patent: Dec. 2, 2003

(54) COATING FOR SUPERPLASTIC AND QUICK PLASTIC FORMING TOOL AND PROCESS OF USING

(75) Inventor: Arianna T. Morales, Royal Oak, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/976,609

(22) Filed: Oct. 15, 2001

(65) Prior Publication Data

US 2003/0070464 A1 Apr. 17, 2003

(51) Int. Cl.[7] ..... B21B 45/02

(52) U.S. Cl. ..... 72/42; 72/60; 72/462; 428/698

(58) Field of Search ..... 72/42, 60, 462, 72/41, 43; 304/913; 428/698, 141, 174, 472, 697

(56) References Cited

U.S. PATENT DOCUMENTS 5,776,588 A * 7/1998 Moriguchi et al. ..... 428/210
5,819,572 A 10/1998 Krajewski ..... 72/42
5,871,850 A * 2/1999 Moriguchi et al. ..... 428/651

* cited by examiner

*Primary Examiner*—Allen Ostrager
*Assistant Examiner*—John S Goetz
(74) *Attorney, Agent, or Firm*—Kathryn A. Marra

(57) ABSTRACT

A coating for superplastic forming (SPF) and quick plastic forming (QPF) tooling and an SPF/QPF process made possible with the coating. The coating defines the forming surface of an SPF/QPF tool, and consists essentially of either a tungsten carbide cermet or a chromium carbide cermet. The coating preferably comprises a metal matrix containing tungsten carbide or chromium carbide particles having a particle size of not more than 0.1 micrometer, and is preferably prepared to have a surface finish of not rougher than 0.3 micrometer Ra. An SPF/QPF process that makes use of a tool whose forming surface is provided with the coating can be performed without depositing any lubricant on the forming surface or workpiece.

26 Claims, 1 Drawing Sheet

COATING FOR SUPERPLASTIC AND QUICK PLASTIC FORMING TOOL AND PROCESS OF USING

STATEMENT REGARDING FEDERALLY-SPONSORED RESEARCH

Not applicable.

BACKGROUND OF THE INVENTION

The present invention generally relates to metal forming methods and tooling used therefor. More particularly, this invention relates to a coating for tooling used in superplastic forming (SPF), quick plastic forming (QPF), and related forming methods, and to a forming process made possible with the coating as a result of the coating reducing wear and sticking between the tooling and the article formed thereon to the extent that the use of lubricants can be significantly reduced or eliminated.

The term "superplasticity" is used to denote the exceptional ductility that certain metal alloys can exhibit when deformed under proper conditions, the process of which is known as superplastic forming (SPE). Typical examples are titanium and aluminum alloys capable of being deformed to elongations in excess of 100%. General conditions for superplasticity include very fine grain size (e.g., less than ten micrometers), high temperatures (e.g., greater than one-half of the absolute melting temperature of the alloy) and a controlled strain rate (typically $10^{-4}$ to $10^{-3}$ $s^{-1}$). A related forming process referred to as "quick plastic forming" (QPF) is disclosed in commonly-assigned U.S. Pat. No. 6,253,588, and enables more rapid strain rates (above $10^{-3}$ $s^{-1}$) to provide a more economical and practical process for mass-producing parts.

SPF and QPF methods typically involve blow-forming a sheet of the desired alloy into a sculptured ferrous tool that is heated to an appropriate forming temperature, yielding a deformed workpiece that is in intimate contact with the tool. The workpiece must release cleanly from the tool in order to maintain its integrity, such as dimensional accuracy and surface finish, particularly if a Class A type surface ($R_a$ below 50 microinches (1.27 micrometers)) is desired, as is the case with automobile body panels. However, the intimate contact that occurs between the workpiece and tool during an SPF/QPF process leads to the action of interatomic forces (adhesion, friction) to the extent that workpiece release and quality are processing issues with SPF/QPF. Workpiece adhesion leads to galling patterns appearing on the finished workpiece surfaces, and forcible separation of a workpiece from an SPF tool can distort the workpiece beyond its allowable dimensions. Under such conditions, the use of a robotic material handling system would be very difficult to implement, eliminating the possibility of having a large-scale production process.

As a result, SPF/QPF tooling and/or the workpiece are coated with a lubricant or release agent, such as graphite or boron nitride, to prevent sticking and bonding of the workpiece to the tooling. An alternative is an improved SPF/QPF release agent comprising magnesium hydroxide ($Mg(OH)_2$), disclosed in commonly-assigned U.S. Pat. No. 5,819,572 to Krajewski. While suitable for many applications, lubricants can have an adverse effect on the final surface characteristics of a superplastically formed workpiece. As an example, the surface characteristics of an aluminum part formed by SPF on a ferrous tool strongly depend on the conditions of the tool surface and the amount of lubricant applied. In addition to machining marks, scratches and excessive roughness of the tool surface, any lubricant buildup on the tool will be reproduced on the workpiece surface during the forming process, and potentially prevent the production of a Class A type surface. Excess lubricant is also associated with necking and eventual breaks in a workpiece due to excessive slippage between the workpiece and tool. On the other hand, insufficient lubricant is a common cause of breaks, splits and incomplete forming of workpiece details.

In view of the above, it would be desirable if an improved SPF/QPF tooling and process were available that was less prone to workpiece sticking and therefore workpiece distortion and dimensional inaccuracies, while also enabling the production of parts with excellent surface characteristics.

BRIEF SUMMARY OF THE INVENTION

The present invention is directed to a coating for SPF/QPF tooling and an SPF/QPF process made possible with the coating. The coating reduces sticking and wear between the tooling and the workpiece formed thereon to the extent that the use of lubricants can be significantly reduced or eliminated.

The coating of this invention defines the outer surface of an SPF/QPF tool, and consists essentially of either a tungsten carbide cermet or a chromium carbide cermet. The coating preferably comprises a metal matrix containing tungsten carbide or chromium carbide particles having a particle size of not more than 0.1 micrometer, and is preferably prepared to have an average surface roughness (Ra) of not higher than 0.3 micrometer. Under certain conditions, an SPF/QPF process that makes use of a tool whose forming surface is provided with the coating of this invention can be performed without any lubricant on the forming surface or workpiece. As with known SPF and QPF processes, such a process will be carried out at relative high temperatures, e.g., greater than one-half of the absolute melting temperature of the workpiece.

According to the present invention, tooling with tungsten carbide cermet or chromium carbide cermet coatings of this invention have been shown to be more resistant to wear than conventional lubricated SPF/QPF tooling, such that more workpieces can be formed with the tooling without refinishing the tooling forming surface. As a result, tooling of this invention requires less maintenance, and production cost and downtime are reduced. If a lubricant or release agent is used with the coating of this invention, more workpieces can be formed without cleaning the tooling forming surface than with conventional SPF/QPF tooling. If the coating is prepared to be sufficiently effective to reduce or eliminate the need for a lubricant or release agent, the process cycle time can be significantly decreased and the likelihood that the lubricant will degrade the workpiece properties is reduced. Finally, workpieces have been shown to release more readily and cleanly from SPF/QPF tooling protected with the coating of this invention, enabling the mass production of workpieces with Class A type surfaces.

Other objects and advantages of this invention will be better appreciated from the following detailed description.

DETAILED DESCRIPTION OF THE INVENTION

Figure 1:
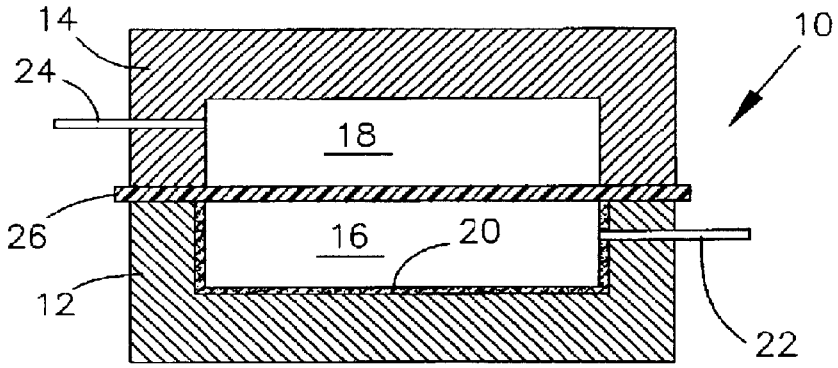
FIGS. 1 and 2 schematically represent a QPF process that employs a tool with a coating in accordance with the present invention.
Figure 2:
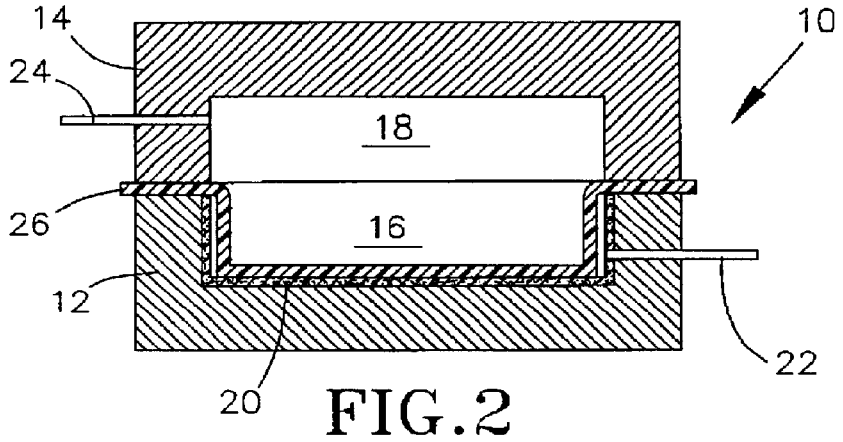

Tooling 10 for a QPF process is represented in FIGS. 1 and 2, along with a workpiece 26 initially in the form of a sheet that is deformed with the tooling 10 to produce a desired article. The tooling 10 is represented as comprising two tools 12 and 14, each having a cavity 16 and 18, respectively. As is conventional with QPF and SPF processes, the tools 12 and 14 may be made of nodular iron, low carbon or low alloy steel, or a tool steel such as AISI P20, though it is foreseeable that other materials could be used. Those skilled in the art will appreciate that FIGS. 1 and 2 are merely intended to schematically represent QPF tooling, and that the workpiece and tooling could differ considerably from that shown. Furthermore, while the invention will be discussed in reference to the QPF tooling and a QPF process, the invention is also applicable to SPF tooling and processes.

As apparent from FIG. 2, the surface of the cavity 16 of the lower tool 12 is generally the forming surface for the QPF process, i.e., against which the workpiece 26 is deformed. The workpiece 26 may be formed of any material capable of exhibiting "superplasticity," meaning that the material exhibits exceptional ductility under appropriate conditions, including a very fine grain size and under high processing temperatures. Examples of suitable materials include titanium and aluminum alloys, a particular example of the latter is the aluminum-magnesium-manganese alloy AA 5083, having a nominal composition of, in weight percent, 4.4 manganese, 0.7 manganese, and 0.15 chromium, balance aluminum and low level alloying elements and impurities. As depicted in FIG. 1, the workpiece 26 is initially clamped between the tools 12 and 14, preferably effecting a gas-tight seal. Once the desired process temperature is reached, a nonreactive gas (e.g., argon) is pumped into the cavity 18 of the upper tool 14 through an inlet 24, gradually forcing the workpiece 26 down into the cavity 16 of the lower tool 12 at a controlled strain rate, e.g., about $10^{-4}$ to $10^{-3}$ $s^{-1}$ for conventional SPF/QPF processes, or greater than $10^{-3}$ $s^{-1}$ for the QPF process disclosed in commonly-assigned U.S. Pat. No. 6,253,588. The lower tool 12 is equipped with an outlet 22 to allow venting of gas from the lower cavity 16. As represented in FIG. 2, the workpiece 26 is deformed by the pressure of the gas (blow-formed), and eventually conforms to the surface of the cavity 16 of the lower tool 12. Thereafter, the workpiece 26 is removed from the tooling 10, and the next workpiece loaded.

According to the present invention, the forming surface of the lower tool 12 is defined by a coating 20 that reduces wear and sticking between the workpiece 26 and the lower tool 12, and preferably reduces or eliminates any requirement of a lubricant release agent on the tool 12 or workpiece 26. For this purpose, the coating 20 must have an acceptable chemical composition, thickness, surface roughness, and hardness that reduces interatomic forces (adhesion, friction) between the work piece and the tool. These characteristics of the coating 20 must also be tailored to provide sufficient friction to facilitate material flow on the tool cavity 16 in some areas while avoiding necking in others. Finally, the coating 20 is preferably capable of being processed to provide an optimal surface configuration that achieves the above, while also enabling the mass production of articles whose surfaces have desirable characteristics, an example of which is the Class A type surface finish desired for automobile body panels.

The coating 20 of this invention is a cermet, i.e., a ceramic and metal mixture in which the metal serves as a binder to the ceramic constituent. Cermet materials suitable for use in the present invention are tungsten carbide (WC) and chromium carbide ($Cr_3C_2$) cermets. Preferred tungsten carbide cermets are those that use cobalt as the principal binding metal, a suitable example of which contains about 88 to about 92 weight percent tungsten carbide and the balance cobalt. WC/Co cermet coatings of this invention can be deposited using a high velocity combustion powder process, commonly referred to as a high-velocity oxy-fuel (HVOF) process. Other suitable deposition methods include detonation gun and plasma spraying. Using the HVOF method, a quantity of WC/Co cermet powder is entrained in a supersonic stream of gases undergoing combustion (e.g., hydrogen and oxygen) within the barrel of a deposition gun, and directed at the surface to be coated. Within the supersonic stream, the powder is heated to a temperature sufficient to melt the powder (e.g., about 3000° C.), and driven at a high velocity (e.g., 700 to 900 m/s) that promotes bonding of the molten material to the targeted surface. WC/Co cermet coatings 20 produced by HVOF have exhibited excellent adhesion and low porosity, high compressive strength, extremely high hardness and wear resistance, and good resistance to adhesive and percussive wear under sliding conditions. However, a WC/Co cermet coating can be highly abrasive unless its surface is polished and the tungsten carbide particles are small. Accordingly, WC/Co cermet coatings 20 of this invention are preferably produced using a powder having a particle size of not greater than about 0.1 micrometer. Depending on the tool material, WC/Co coatings 20 are polished to have a surface finish of about 0.4 or 0.5 micrometer, preferably not rougher than 0.3 micrometer Ra.

Preferred chromium carbide cermets are those consisting of chromium carbide particles in a matrix of a nickel-chromium alloy. A suitable example of such a chromium carbide cermet (CrC/NiCr) coating 20 is about 20 to 80 weight percent chromium carbide particles and the balance an NiCr alloy of about 75 to 80 weight percent nickel, balance chromium and incidental impurities. CrC/NiCr cermet coatings 20 can also be deposited by HVOF methods to be strongly adherent, have a hardness of 700 HV or more, and display excellent wear resistance at temperatures up to 850° C. Preferred CrC/NiCr cermet coatings 20 are produced from a powder having a particle size of not greater than about 0.1 micrometer. As with the WC/Co coatings, the CrC/NiCr coatings 20 are polished to have a surface finish of about 0.4 or 0.5 micrometer, preferably not rougher than 0.3 micrometer Ra, depending on the tool material used.

In an investigation leading to this invention, more than twenty-four different types of coatings and coating methods were evaluated on cast iron, low carbon steel and tool steel tools under SPF and QPF conditions. Of the twenty-four coating materials evaluated, the WC/Co and CrC/NiCr cermet materials of this invention were the best performers. Through the evaluation process, it was determined that a procedure to appropriately prepare the tool surfaces before and after coating was key in the performance of the tools under SPF/QPF conditions. The forming surfaces of tools formed of tool steel were polished to an average surface roughness of approximately 0.3 micrometer Ra. Tools formed of cast iron and low carbon steel were polished to an average surface roughness of approximately 0.4 micrometer Ra, because the degree of polishing that can be achieved with these materials is limited by the graphite particles present in their microstructures. All of the cermet coatings used in this investigation were applied by HVOF. The WC/Co cermet material had a typical composition of about 91 weight percent tungsten carbide and about 9 weight percent cobalt, while the CrC/NiCr cermet material had a typical composition of about 65 weight percent chromium carbide and about 35 weight percent of a nickel-chromium alloy of about 75 to 80 weight percent nickel and the balance chromium. After deposition, the CrC/NiCr and WC/Co coatings had an as-deposited surface roughness of about 1.5 micrometers Ra. The coatings were then polished to achieve a surface finish of not rougher than about 0.3 micrometer Ra. To avoid excessive surface heating, the coatings were polished using flexible diamond discs available from Abrasive Technology, Inc., under the names Genesis and Crystalite Lapidary Products. Table 1 summarizes the compositions and average physical characteristics of the coatings after surface finishing.

TABLE 1

| CHARACTERISTIC | CrC/NiCr cermet | WC/Co cermet |
|---|---|---|
| Deposition Method | HVOF (deposition gun) | HVOF (deposition gun) |
| Composition (wt. %) | 65% $Cr_3C_2$ - 35% Ni—Cr | 91% WC - 9% Co |
| Microhardness (HV) | 700 | 1300 |
| Alloy Density (g/cm$^3$) | 6.5 | 15.5 |
| Porosity (%) | about 1 | about 0.5 |
| Softening Point (° C.) | 850 | 500 |
| Coefficient of Thermal Expansion ($10^{-6}$ in/in/° F.) | 5.6 | 4.1 |

For comparison, tools were evaluated that had been coated with a nickel-phosphorous-TEFLON® (Ni-P-PTFE) coating material (about 8 weight percent phosphorous, 25 weight percent PTFE, balance nickel) commercially available from Nimet Industries. Coatings of this material were deposited to a thickness of about 50 micrometers on tools prepared identically to those for the WC/Co and CrC/NiCr coatings.

Table 2 summarizes the average roughness and thickness measurements of the tested coatings. The measurements are an average of thirty measurements taken on different areas of the tool surface.

TABLE 2

| Characteristic | Ni—P—PTFE | CrC/NiCr | WC/Co |
|---|---|---|---|
| Tool surface roughness before coating (Ra - micrometers) | 0.4 | 0.4/0.3* | 0.4/0.3* |
| Coating roughness after polishing (Ra - micrometers) | 0.4 | 0.3 | 0.3 |
| Coating thickness before SPF/QPF (micrometers) | 30 | 138 | 126 |

*The tool surface roughness before coating was dependent on the tool material: Cast iron and low carbon steel - approximately 0.4 micrometer Ra; Tool steel - approximately 0.3 micrometer Ra.

All of the coated tools were employed in SPF/QPF processes without the use of any lubricants or release agents. Workpiece blanks in the form of sheets having a thickness of about 1.2 millimeters were formed of a coll-rolled AA 5083 aluminum alloy tempered to H-18. The blanks were heated within their tools to a temperature of about 500° C., and then blow-formed at controlled strain rates typical for SPF and QPF processes. Under these conditions, blank sticking to the tool cavities was not initially observed with any of the tools, though sticking eventually occurred toward the end of the investigation with the Ni-P-PTFE tooling. In the absence of sticking, panels were easily separated from the tools without prying. Such a result is in contrast to workpiece sticking that typically occurs if a lubricant or release agent is not used in an SPF/QPF process, and which necessitates prying the workpiece from the tool with a significant risk of distortion. It was therefore concluded that lubrication and surface conditioning of incoming workpieces can be substantially or completely eliminated with the tool coating materials processed in the manner described above. Consequently, only conventional cleaning and blanking would be required to prepare a workpiece for SPF or QPF in a tool provided with one of the coatings of this invention.

Figure 3:
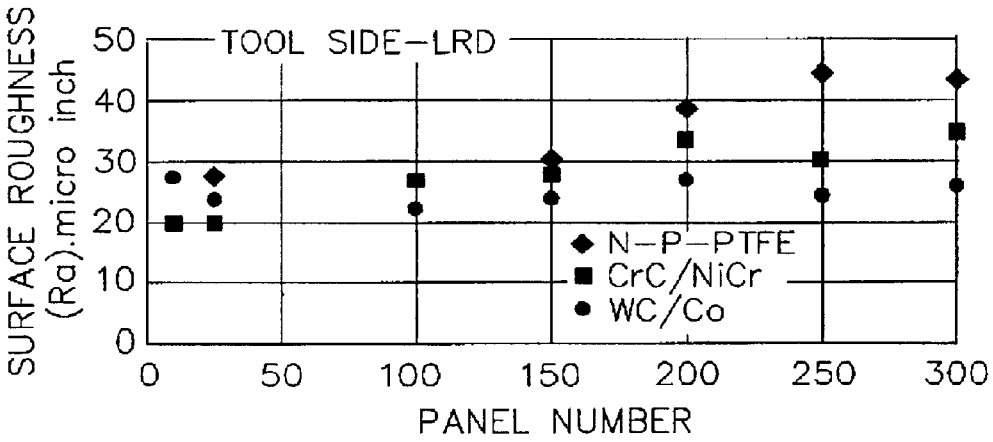
FIG. 3 is a graph comparing the surface finishes of workpieces produced with tools equipped with coatings of this invention and a baseline coating.

FIG. 3 summarizes the average roughness and thickness measurements of the panels produced with the coated tools. The measurements were taken on the side of the panels that was in contact with the tool surface during the forming process, and along the material's rolling direction. The roughness values for the panels can be seen to increase with the number of panels produced. However, the increase is more marked in the case of panels formed with the Ni-P-PTFE coated tools, which had a final average roughness of about 43 micro-inches (about 1.1 micrometers). After forming 150 panels, the tool surface of the Ni-P-PTFE coated tools roughened at a faster rate than in the previous forming cycles, suggested an accelerated degradation of the coating that presumably led to the above-noted workpiece sticking. In contrast, the panels formed with the CrC/NiCr-coated tools had a maximum surface roughness of only about 33 micro-inches (about 0.84 micrometer). An increase in the surface roughness was noted after forming one hundred panels, but afterwards roughness stabilized at about 30 micro-inches (about 0.76 micrometer). In the case of the WC/Co-coated tools, the maximum roughness value was never higher than about 28 micro-inches (about 0.71 micrometer). Therefore, in terms of the surface roughness of the formed panels, the WC/Co and CrC/NiCr-coated tools performed significantly better than the Ni-P-PTFE-coated tools under superplastic forming conditions, with the WC/Co-coated tools performing slightly better than the CrC/NiCr-coated tools.

Table 3 summarizes the results obtained by measuring the mirror-like reflection and wavy appearance ("orange peel") of panels formed with each of the coated tools and then painted under production conditions. The results shown in Table 3 are averages for the 300th panel of each of the test series, and are compared with the minimum acceptable values for a Class A surface ("Class A Spec."). Class A surfaces were obtained with all of the panels formed with tools coated in accordance with this invention.

TABLE 3

| PAINTED BODY APPEARANCE | COATING MATERIAL | | CLASS A |
|---|---|---|---|
| AFTER 300 PANELS | CrC/NiCr | WC/Co | SPEC. |
| Distinctiveness of Image (DOI)[1] | 95 | 98 | >85 |
| Orange Peel[2] | 8.8 | 9.0 | >6.5 |

[1]DOI - The mirror-like reflection of a painted surface.
[2]Rough or wavy appearance of a painted surface which may have texture.

In addition to further evidencing that tools with forming surfaces provided with the coatings of this invention can be used to superplastically form parts in a consistent manner without a parting agent or lubricant, the above results also showed that such tools are capable of producing surfaces that meet Class A surface requirements.

Table 4 summarizes the coating thickness and roughness of the forming surface of each tool after forming three hundred panels. The measurements were made in approximately the same positions as the initial measurements reported in Table 2 by using the same template for all tools.

TABLE 4

| COATING CONDITION AFTER 300 PANELS | Ni—P—PTFE | CrC/NiCr | WC/Co |
|---|---|---|---|
| Coating Roughness (Ra - micrometers) | 0.6 | 0.3 | 0.3 |
| Coating Thickness (micrometers) | 9.40 | 137 | 128 |

The average remaining thickness of the Ni-P-PTFE coating was about 31.33% of the coating thickness (thirty micrometers) initially applied to the tool surface. Marked variation on the tool surface roughness was also observed. Though the end of the Ni-P-PTFE coating life had not yet been reached, the increase in surface roughness and the loss of coating thickness suggested that the useful life of this coating may not greatly exceed three hundred of the particular panels formed.

In contrast, the CrC/NiCr and WC/C coatings did not show significant variations in their surface roughnesses or thicknesses after forming the same number of panels. Small variations observed in their thicknesses were believed to be attributable to experimental errors associated with measurement techniques and equipment. In any event, the coating life for each coating of this invention is apparently significantly greater than the three hundred panels produced in the investigation. Since the wear mechanism of the coatings under SPF/QPF conditions is not totally understood, extrapolations based on the results were considered to be inappropriate. Nonetheless, the results of these tests evidence that the WC/Co and CrC/NiCr coatings of this invention should be suitable for production SPF/QPF tooling used for large-scale volume processing.

In view of the above, it was concluded that a tool whose forming surface is provided with only a CrC/NiCr or WC/Co cermet coating, i.e., without a lubricant or release agent, can be used to superplastically form Class A surface parts in a consistent manner. Notably, the coatings of this invention did not show significant variations in their surface roughnesses or thicknesses after forming a relatively large number of parts. Under the conditions described above, it was concluded that proper tool surface preparation should be performed before and after coating in order to completely avoid sticking of an aluminum sheet to a ferrous tool surface. Such preferred preparation includes polishing the tool surface to a finish of about 0.4 to about 0.5 micrometer Ra for cast iron and about 0.4 micrometer Ra for tool steels, followed by depositing the coating and polishing the coated surface to obtain a finish of about 0.2 to 0.3 micrometer Ra and a final coating thickness of about 100 to 250 micrometers. A suitable as-deposited coating thickness is believed to be about 7 to 9 mils (about 0.18 to 0.23 millimeter), and a suitable final coating thickness is about 150 micrometers after polishing.

Subsequent to the above investigation, in-plant trials were performed with tools made from cast iron and AISI P20 tool steel. Some of the P20 tools were provided with the CrC/NiCr cermet coating of this invention, while others were left uncoated to establish a baseline for conventional production tooling. The cast iron tools were all coated with the WC/Co cermet coating of this invention. The forming surfaces of all tools were coated with boron nitride as a lubricant. The uncoated baseline tooling required a lubricant thickness of about 350 microinches (about 8.9 micrometers), while lubricant coatings of about 250 microinches (about 6.4 micrometers) and about 150 microinches (about 3.8 micrometers) were used with the WC/Co and CrC/NiCr coatings, respectively. In the production of identical panels requiring a Class A surface finish, the uncoated tools exhibited significantly increasing wear after forming about 150 panels, while no wear was detected for the WC/Co and CrC/NiCr coatings after forming over 300 and 1300 panels, respectively. In addition, the uncoated tools required cleaning after every fourteen panels and refinishing after every 500 parts on average. In contrast, tooling with the WC/Co and CrC/NiCr coatings of this invention required cleaning after every fifty panels, and did not require refinishing after producing over 300 and 1500 panels, respectively.

While the invention has been described in terms of preferred embodiments, it is apparent that other forms could be adopted by one skilled in the art. Furthermore, while the invention has been discussed specifically in reference to SPF and QPF tools and processes (all of which are encompassed by the phrase "superplastic forming" in the claims), it is foreseeable that the WC/Co and CrC/NiCr coatings could be used in other types of forming operations. Accordingly, the scope of the invention is to be limited only by the following claims.

What is claimed is:

1. A superplastic forming tool comprising a coating on a surface thereof, the surface having a surface finish of not rougher than 0.5 micrometer Ra, the coating covering the surface to define a forming surface of the tool, the coating consisting essentially of either a tungsten carbide cermet or a chromium carbide cermet, the coating having a surface finish of not rougher than 0.3 micrometer Ra.

2. The superplastic forming tool according to claim 1, wherein the coating comprises tungsten carbide or chromium carbide particles in a metal matrix, the particles have a particle size of not more than 0.1 micrometer.

3. The superplastic forming tool according to claim 1, wherein the tool is formed from a material chosen from the group consisting of nodular iron, low carbon iron, low alloy steel and tool steel.

4. The superplastic forming tool according to claim 1, wherein the coating is the tungsten carbide cermet, the tungsten carbide cermet comprising tungsten carbide particles in a matrix of cobalt.

5. The superplastic forming tool according to claim 4, wherein the tungsten carbide particles have a particle size of not more than 0.1 micrometer and constitute about 88 to about 92 weight percent of the coating.

6. The superplastic forming tool according to claim 1, wherein the coating is the chromium carbide cermet, the chromium carbide cermet comprising chromium carbide particles in a matrix of a nickel-chromium alloy matrix.

7. The superplastic forming tool according to claim 6, wherein the chromium carbide particles have a particle size of not more than 0.1 micrometer and constitute about 20 to about 80 weight percent of the coating.

8. A superplastic forming tool comprising an external coating on a surface thereof, the surface having a surface finish of not rougher than 0.5 micrometer Ra, the coating covering the surface to define a forming surface of the tool, the coating having a surface finish of about 0.2 to about 0.3 micrometer Ra and a thickness of less than 0.2 millimeter, the coating consisting of a cermet material containing tungsten carbide particles in a cobalt matrix or chromium carbide particles in a nickel-chromium alloy matrix, the particles having a particle size of not more than 0.1 micrometer.

9. The superplastic forming tool according to claim 8, wherein the cermet material consists of the tungsten carbide particles in the cobalt matrix.

10. The superplastic forming tool according to claim 9, wherein the tungsten carbide particles have a particle size of not more than 0.1 micrometer.

11. The superplastic forming tool according to claim 8, wherein the cermet material consists of about 20 to about 80 weight percent of the chromium carbide particles, the balance being essentially the nickel-chromium alloy matrix.

12. The superplastic forming tool according to claim 11, wherein the chromium carbide particles have a particle size of not more than 0.1 micrometer.

13. A superplastic forming process comprising the steps of:

polishing a surface of a forming tool to have a surface finish of not rougher than 0.5 micrometer Ra;

providing a coating on the surface of the forming tool, the coating consisting essentially of either a tungsten carbide cermet or a chromium carbide cermet;

polishing the coating to define a forming surface having a surface finish of not rougher than 0.3 micrometer Ra; and without depositing a lubricant on the forming surface, superplastically forming a workpiece on the forming surface of the forming tool.

14. The superplastic forming process according to claim 13, wherein the coating is the tungsten carbide cermet, the tungsten carbide cermet comprising tungsten carbide particles in a matrix of cobalt, the tungsten carbide particles having a particle size of not more than 0.1 micrometer and constituting about 88 to about 92 weight percent of the coating.

15. The superplastic forming process according to claim 12, wherein the coating is the chromium carbide cermet, the chromium carbide cermet comprising chromium carbide particles in a matrix of a nickel-chromium matrix, the chromium carbide particles having a particle size of not more than 0.1 micrometer and constituting about 20 to about 80 weight percent of the coating.

16. The superplastic forming process according to claim 13, wherein the superplastic forming step is performed at a temperature of greater than one-half of the absolute melting temperature of the workpiece.

17. The superplastic forming process according to claim 13, wherein the workpiece is formed of an aluminum-magnesium-manganese alloy.

18. The superplastic forming process according to claim 13, wherein the coating is provided on the surface by depositing the coating using a high-velocity combustion powder spray technique.

19. A superplastic forming process comprising the steps of:

polishing a surface of a ferrous forming tool to have a surface finish of not rougher than 0.5 micrometer Ra;

depositing a coating on the surface to a thickness of about 0.18 to 0.23 millimeters micrometer, the coating consisting essentially of either a tungsten carbide cermet or a chromium carbide cermet;

polishing the coating to define a forming surface having a surface finish of about 0.2 to 0.3 micrometer Ra and a thickness of about 150 micrometers; and then superplastically forming a workpiece on the forming surface of the forming tool.

20. The superplastic forming process according to claim 19, wherein the superplastic forming step is performed without depositing a lubricant on the forming surface.

21. The superplastic forming process according to claim 19, wherein the coating is a tungsten carbide cermet comprising tungsten carbide particles in a matrix of cobalt, the tungsten carbide particles having a particle size of not more than 0.1 micrometer and constituting about 88 to about 92 weight percent of the coating.

22. The superplastic forming process according to claim 19, wherein the coating is a chromium carbide cermet comprising chromium carbide particles in a matrix of a nickel-chromium matrix, the chromium carbide particles having a particle size of not more than 0.1 micrometer and constituting about 20 to about 80 weight percent of the coating.

23. The superplastic forming process according to claim 19, wherein the superplastic forming step is performed at a temperature of greater than one-half of the absolute melting temperature of the workpiece.

24. The superplastic forming process according to claim 19, wherein the workpiece is formed of an aluminum-magnesium-manganese alloy.

25. The superplastic forming process according to claim 19, wherein the forming tool is formed of a cast iron and the surface thereof has a surface finish of about 0.4 to about 0.5 micrometer Ra.

26. The superplastic forming process according to claim 19, wherein the forming tool is formed of a tool steel and the surface thereof has a surface finish of about 0.4 micrometer Ra.

* * * * *